US010827792B1

(12) United States Patent
Sims

(10) Patent No.: US 10,827,792 B1
(45) Date of Patent: Nov. 10, 2020

(54) WIG FOUNDATION WITH A STITCHED BOTTOM HEM

(71) Applicant: Joe Ann Sims, Henderson, NV (US)

(72) Inventor: Joe Ann Sims, Henderson, NV (US)

( * ) Notice: Subject to any disclaimer, the term of this patent is extended or adjusted under 35 U.S.C. 154(b) by 0 days.

(21) Appl. No.: 16/287,580

(22) Filed: Feb. 27, 2019

Related U.S. Application Data

(63) Continuation-in-part of application No. 15/396,407, filed on Dec. 30, 2016, now abandoned.

(51) Int. Cl.
*A41G 3/00* (2006.01)

(52) U.S. Cl.
CPC ..... *A41G 3/0058* (2013.01); *A41G 3/0033* (2013.01)

(58) Field of Classification Search
CPC ..... A41G 3/00; A41G 3/016; A41G 3/0041; A41G 3/005; A41G 3/0033; A42B 1/22; A42B 3/145
See application file for complete search history.

(56) References Cited

U.S. PATENT DOCUMENTS 6,467,096 B1 * 10/2002 Coluccio ..... A42B 1/22 2/171
9,089,178 B1 * 7/2015 Clarke ..... A41G 3/00
2015/0128979 A1 * 5/2015 Suh ..... A41G 3/005 132/54
2016/0338437 A1 * 11/2016 Couch ..... A41G 3/0041

* cited by examiner

*Primary Examiner* — Rachel R Steitz
(74) *Attorney, Agent, or Firm* — Quickpatents, LLC; Kevin Prince

(57) ABSTRACT

A wig foundation with a stitched support hem including an inverted bowl-shaped stretchable cap having a center portion and a pair of semicircular side panels. A pocketed band is attached to a bottom edge of the cap. A pair of openings of the pocketed band are medially disposed between a back end of each of a right seam and a left seam of a pair of seams. A single elasticized strap is threaded through both the pocketed band and a right opening and a left opening of the pair of openings so that a first end and a second end of the single elasticized strap are disposed outside of the cap. A tightening mechanism is attached to the single elasticized strap proximal the first and second ends thereof, and is configured to selectively tighten the cap around a head of a wearer by selectively tightening the single elasticized strap.

20 Claims, 10 Drawing Sheets

WIG FOUNDATION WITH A STITCHED BOTTOM HEM

CROSS-REFERENCE TO RELATED APPLICATIONS

U.S. patent application Ser. No. 14/970,979 Filed Dec. 16, 2015
CIP 1

FEDERALLY SPONSORED RESEARCH OR DEVELOPMENT

Not Applicable

INCORPORATION BY REFERENCE OF MATERIAL SUBMITTED ON A COMPACT DISK

Not Applicable

TECHNICAL FIELD OF THE INVENTION

The present invention relates to wig foundations, and more particularly, to a wig foundation with a stitched support hem.

BACKGROUND OF THE INVENTION

Various types of wig foundations are known in the prior art. However, what has been needed is a wig foundation with a stitched support hem including an inverted bowl-shaped stretchable cap having a center portion and a pair of semi-circular side panels, as well as a pocketed band attached to a bottom edge of the cap and a pair of openings of the band medially disposed between a back end of each of a right seam and a left seam of a pair of seams. What has been further needed is a stitched support hem continuously disposed on the pocketed band proximal the bottom edge of the cap. Lastly, what has been needed is for a single elasticized strap having a first end and a second end to be threaded through both the band and the right opening and the left opening thereof, such that the first end and the second end are disposed outside of the cap. A tightening mechanism is attached to the single elasticized strap proximal the first end and the second end thereof, and is configured to selectively tighten the cap around the head of the wearer by selectively tightening the single elasticized strap.

The wig foundation with a stitched support hem is thus different from other wig foundations because of its improved stability and comfort as a result of the combination of the pair of straps and the pocketed band which fully encircles a circumference of a wearer's head. Furthermore, the wig foundation with a stitched support hem is ideal for A Wig that has only combs or hair clips that are attached for support. Since the wig foundation with a stitched support hem is attached to a Wig to provide a much tighter fit around the wearer's head. Also, this Wig Cap is designed for a Wig that need more support and tightness around the wearer's head. This Wig Cap allows confidence that the wig is more securely fitted on the head. It is sewn along the bottom edge of a Wig that need more support, fit and tightness. It gives the wearer more confidence that the wig is more securely in place and less chance of sliding off or being blown off by the wind. Using this Wig Cap a wearer can sleep, shower or go into the pool.

SUMMARY OF THE INVENTION

The general purpose of the present wig foundation with a stitched support hem, described subsequently in greater detail, is to provide a wig foundation which has many novel features that result in a wig foundation with a stitched support hem which is not anticipated, rendered obvious, suggested, or even implied by prior art, ether alone or in combination thereof.

To accomplish this, the present wig foundation with a stitched support hem includes an inverted bowl-shaped stretchable cap having a center portion and a pair of semi-circular side panels including a right side panel and a left side panel. The cap is optionally a nylon mesh in order to improve air circulation and enhance breathability of the scalp. Each of the right side panel and the left side panel is attached to a right edge and a left edge, respectively, of the center portion along each of a right seam and a left seam, respectively, of a pair of seams. A pocketed band is attached to a bottom edge of the cap. The band has a lower edge and a pair of openings including a right opening and a left opening. The right opening and the left opening are medially disposed between a back end of each of the right seam and the left seam.

A stitched support hem having a reinforcement stitching and a reinforced area is continuously disposed on the pocketed ban proximal a lower edge of the band. The reinforced area is between the reinforcement stitching and the lower edge of the band, and is used to sew on a Wig. A full 360° circumference hair piece can be attached to the stitched support hem and sewn all the way to the lower edge of the band. This is to provide a Wig that need more support and tightness around the wearer's head.

The wig foundation with a stitched support hem further includes a pair of identical elasticized straps. The pair of straps includes a right strap and a left strap. Each of the right strap and the left strap has a top end and a bottom end. The top end of each of the right strap and the left strap is attached to an interior surface of the band proximal a front end of the right seam and a front end of the left seam, respectively. Each of the right strap and the left strap is threaded through both the band and the right opening and the left opening, respectively, so that the bottom end of each of the right strap and the left strap is disposed outside of the cap. A tightening mechanism is attached to the pair of straps proximal the bottom end. The tightening mechanism is configured to selectively tighten the cap around a head of a wearer by selectively tightening the pair of straps. In a preferred embodiment of the invention, a single elasticized strap having a first end and a second end is used in place of the pair of elasticized straps. The single elasticized strap is threaded through both the band and the right opening and the left opening so that the first end and the second end are disposed outside of the cap. The tightening mechanism is attached to the single elasticized strap proximal the first end and the second end thereof, and is configured to selectively tighten the cap around the head of the wearer by selectively tightening the single elasticized strap.

The combination of the pair of straps and the continuous pocketed band ensures that greater coverage and support is provided around a circumference of the wearer's head. The cap is also structured to be used with a lace top closure. Additionally, combs, clips and a top facing can be used when installing a lace top closure, or a substantially rectangular mesh panel.

A substantially rectangular mesh panel is optionally disposed within the center portion of the inverted bowl-shaped stretchable cap from proximally above the pocketed band to the lower edge of the pocketed band. The mesh panel is structured so that when a closure or frontal is placed on top of the cap, it will show as scalp color. The mesh panel is preferably made out of the thinnest mesh material possible in order to maintain the appearance that hair is growing from a wearer's scalp. Additionally, the size and color of the mesh panel can vary based on the preferences of the wearer.

Thus has been broadly outlined the more important features of the present wig foundation with a stitched support hem so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
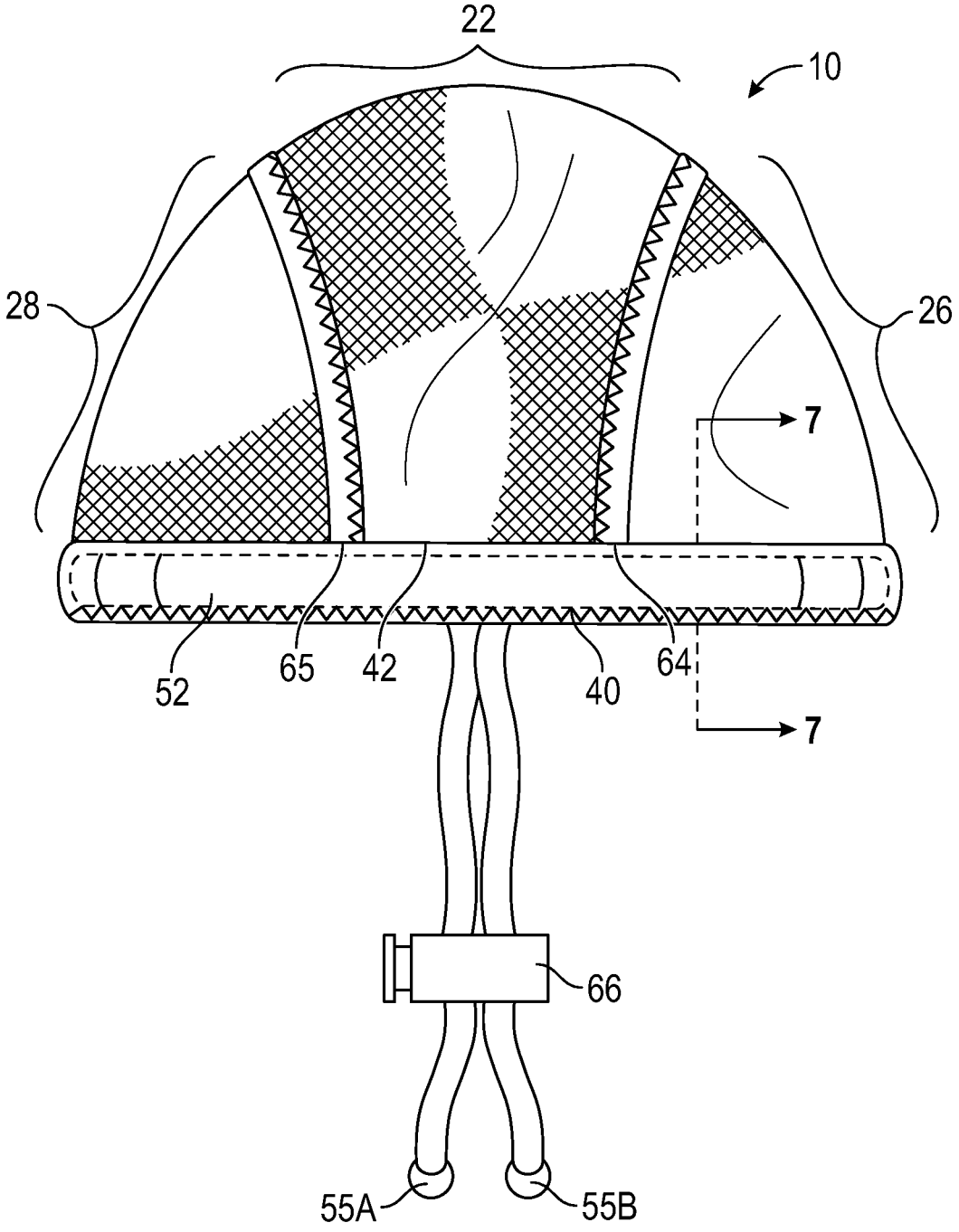
FIG. 1 is a front elevation view.
Figure 2:
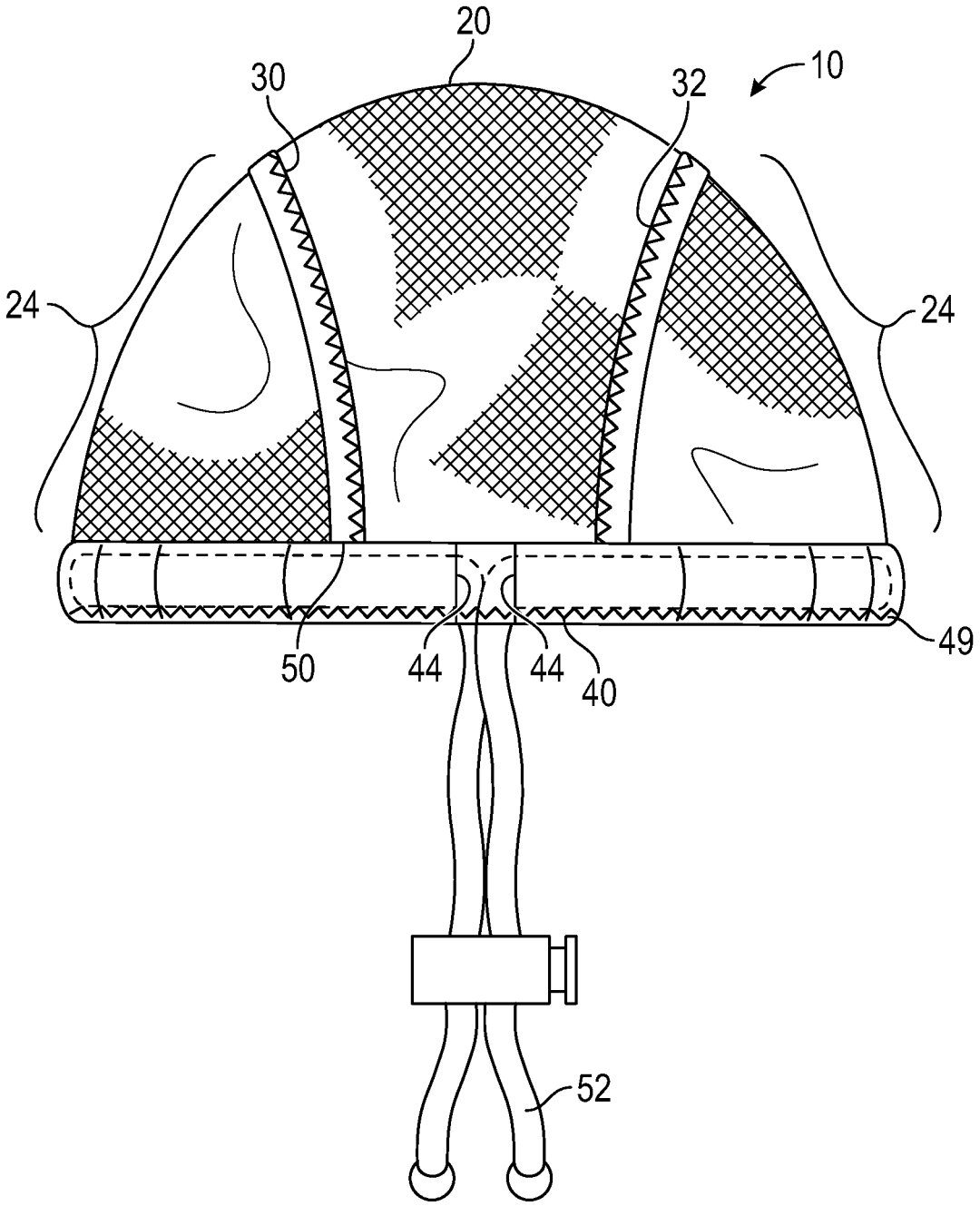
FIG. 2 is a rear elevation view.
Figure 3:
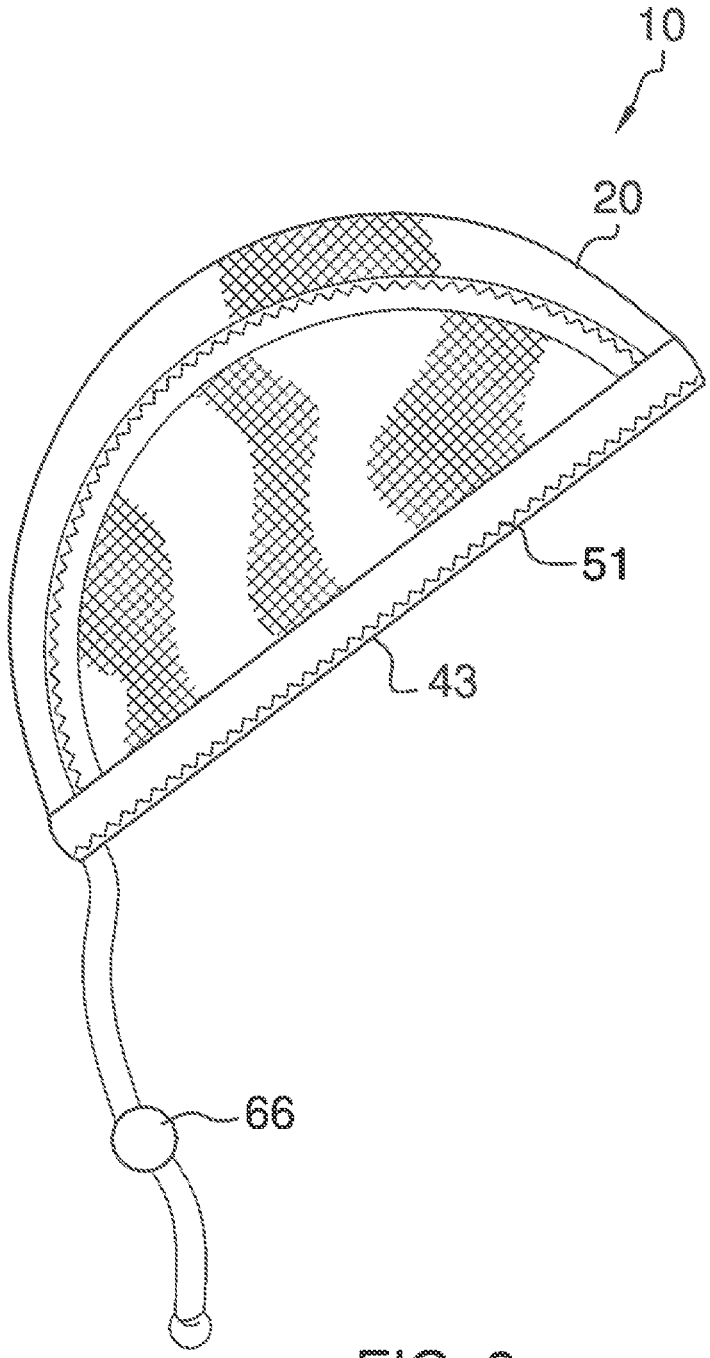
FIG. 3 is a side elevation view.
Figure 4:
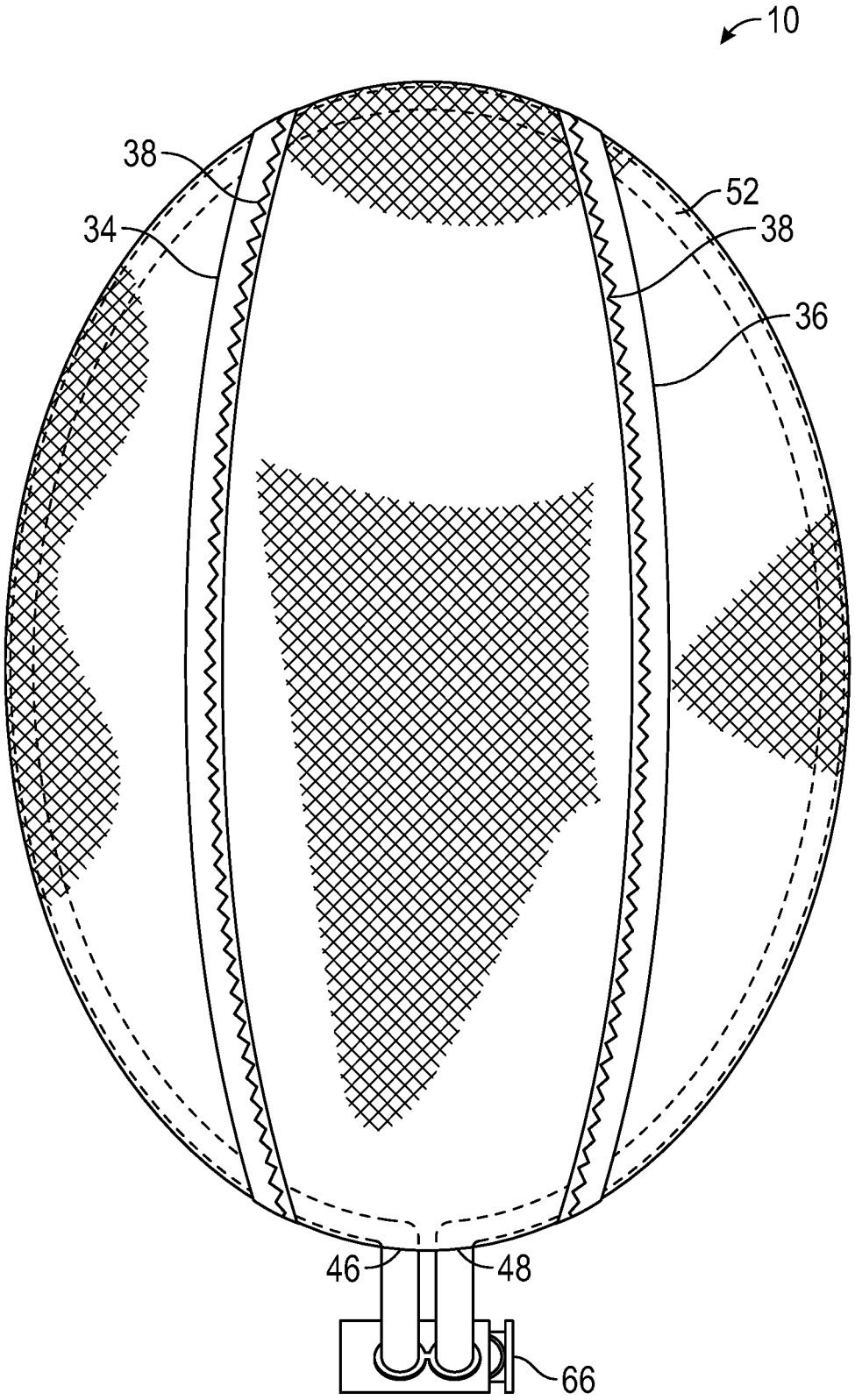
FIG. 4 is a top plan view.
Figure 5:
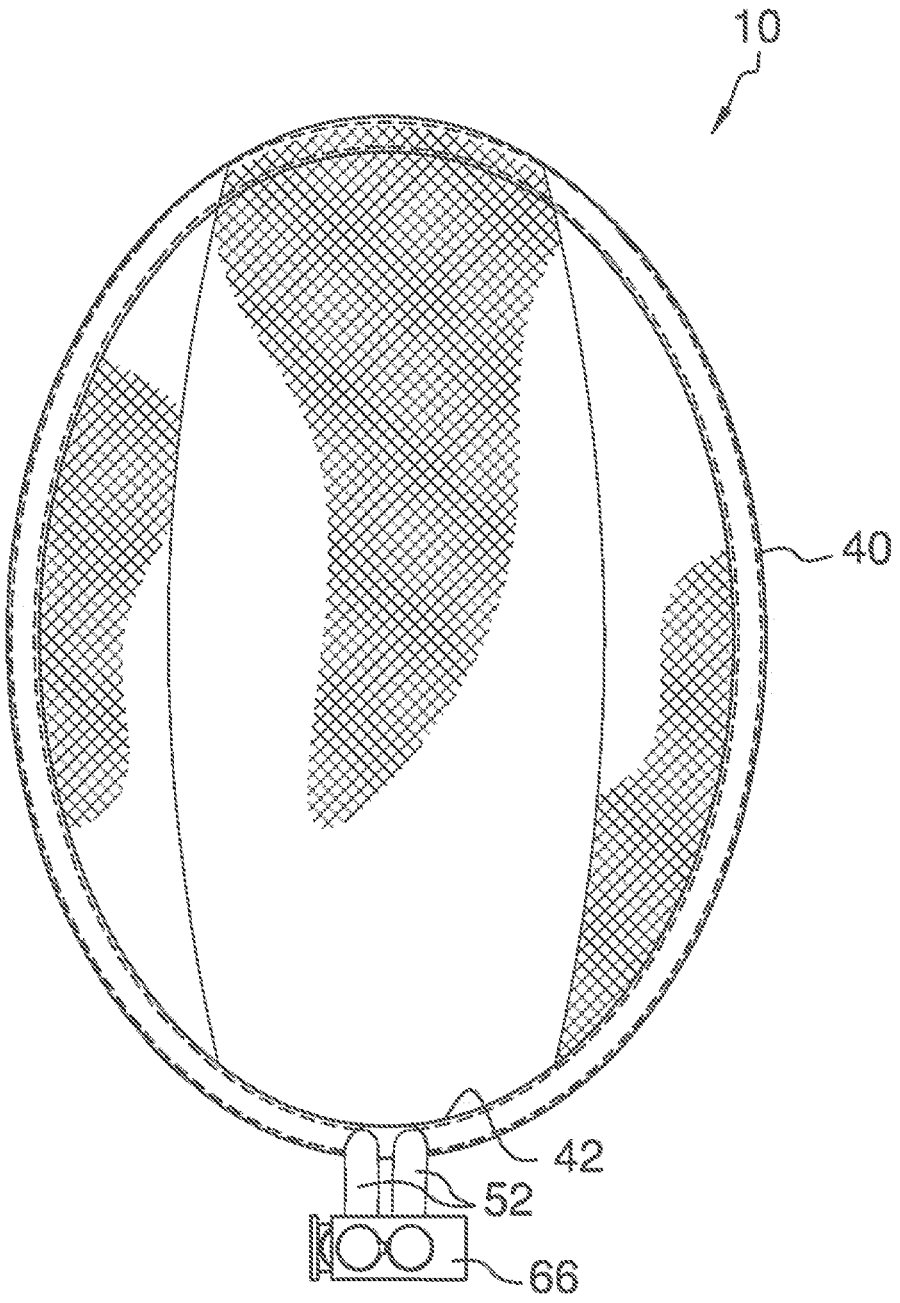
FIG. 5 is a bottom plan view.
Figure 6:
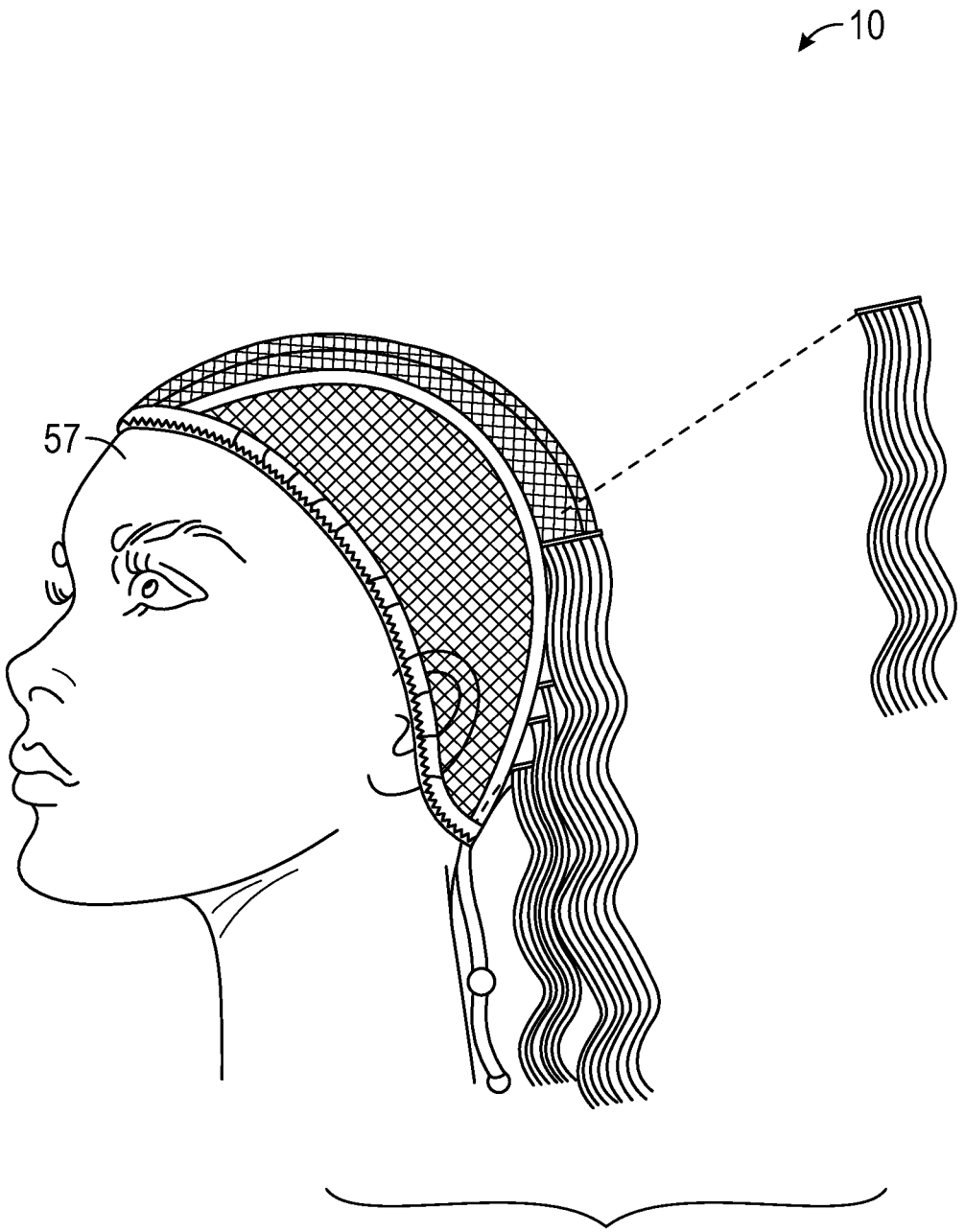
FIG. 6 is an in-use view.
Figure 7:
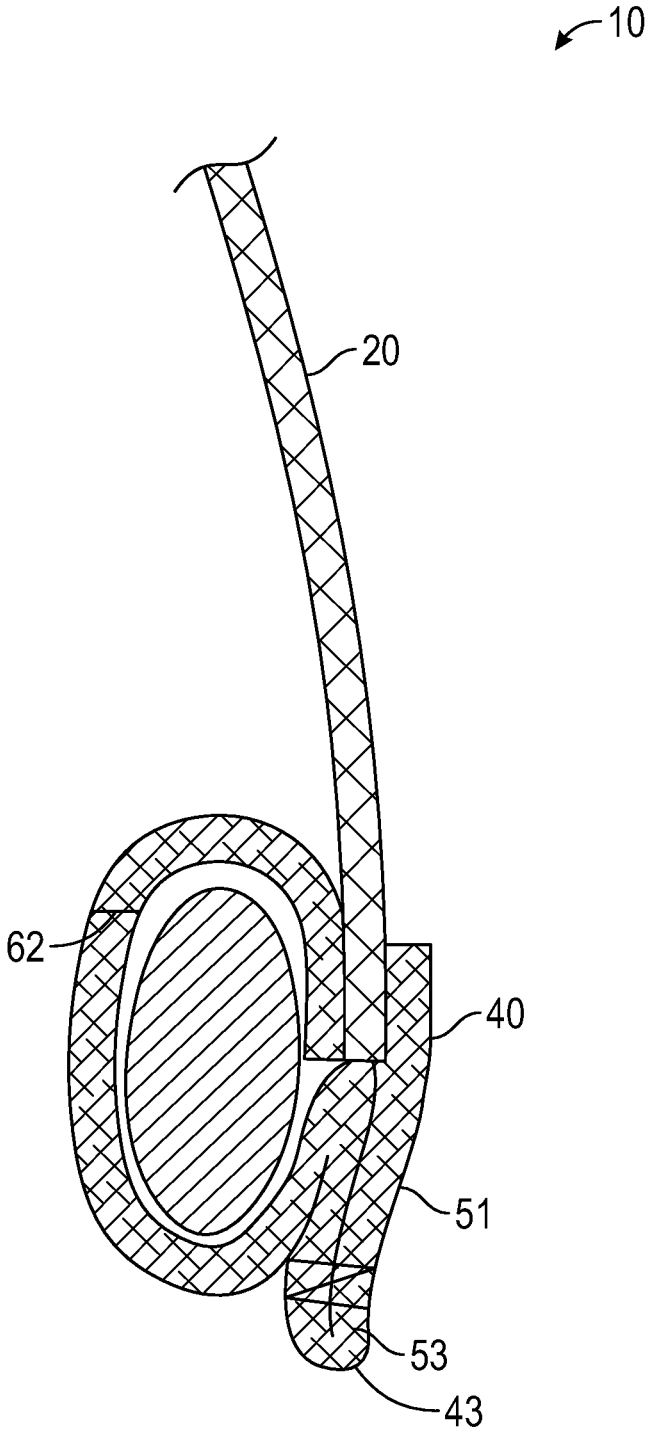
FIG. 7 is a cross-sectional view taken along line 7-7 of FIG. 1.
Figure 8:
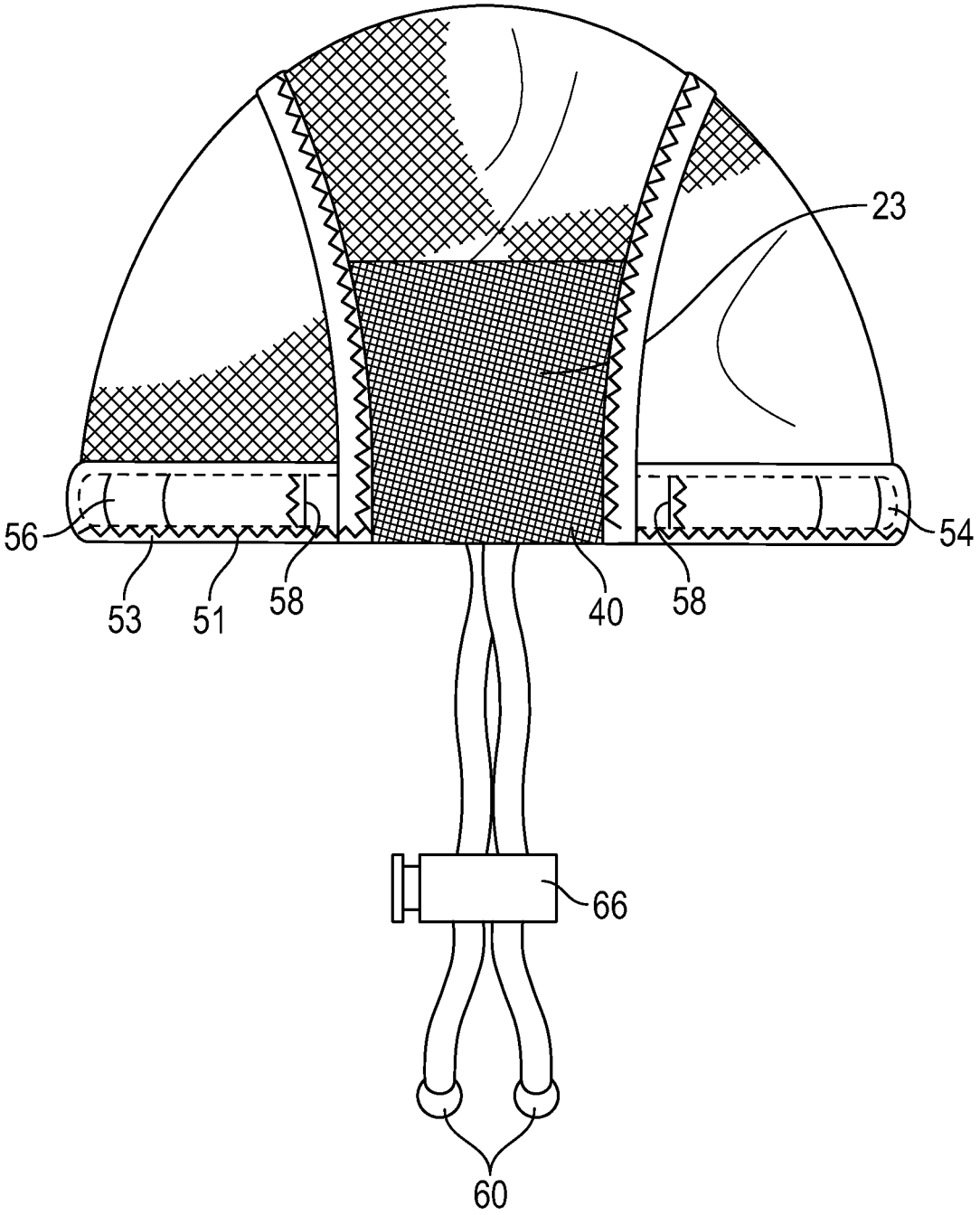
FIG. 8 is a front elevation view showing a mesh panel.
Figure 9:
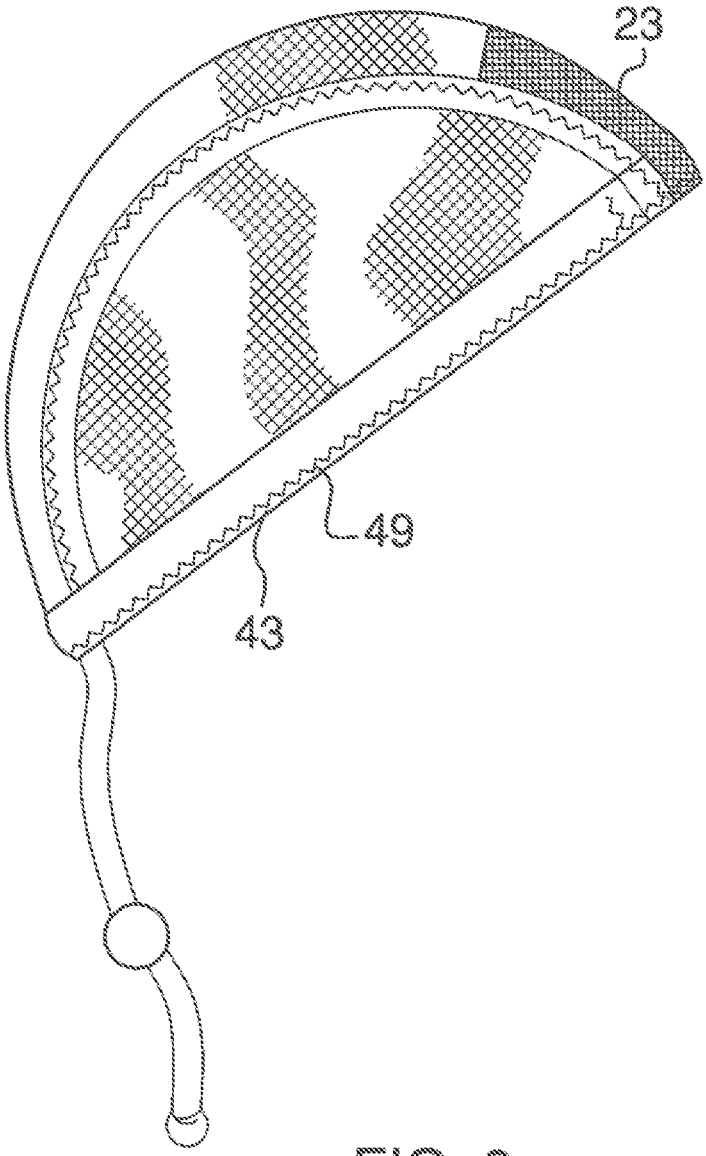
FIG. 9 is a side elevation view showing the mesh panel.
Figure 10:
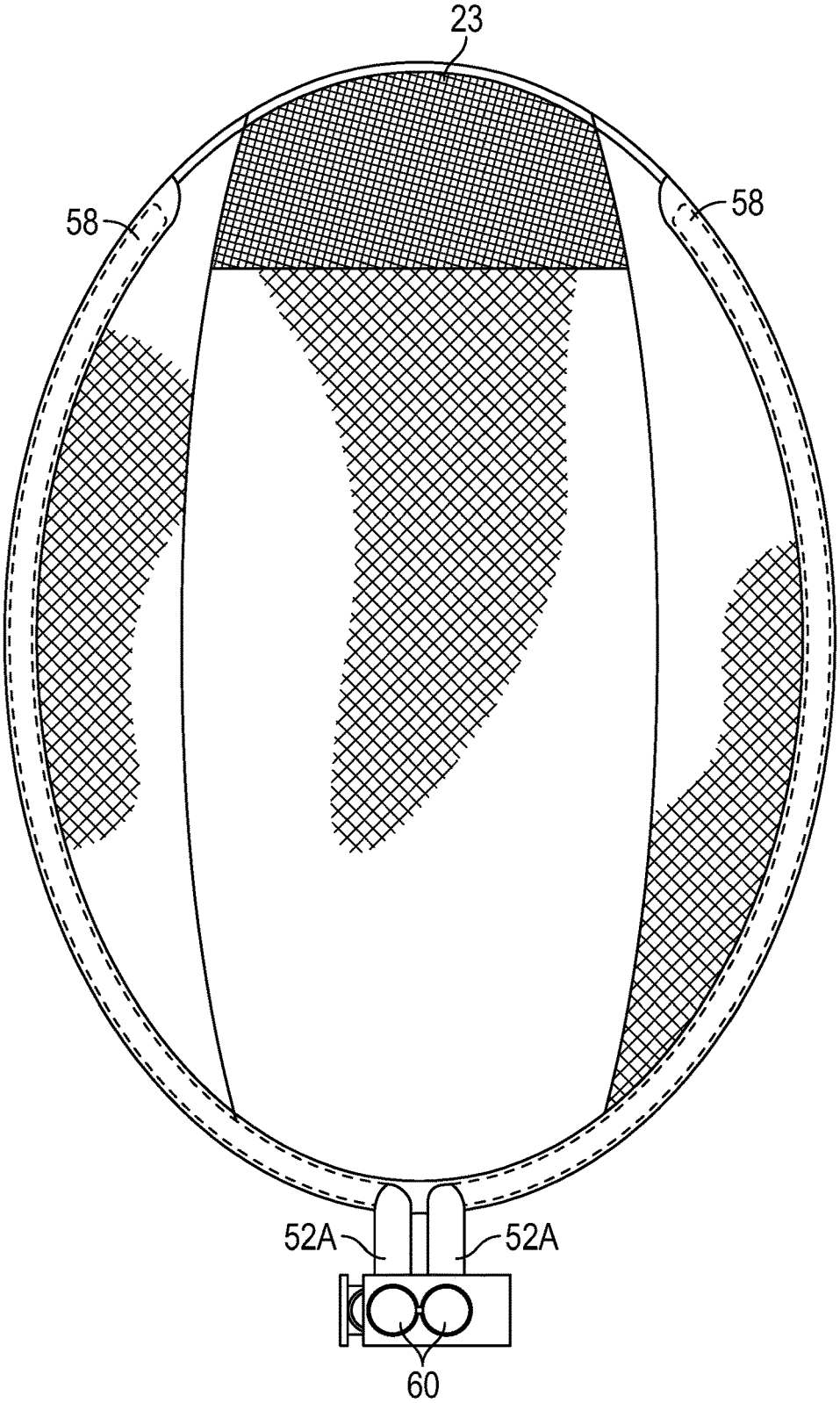
FIG. 10 is a bottom plan view showing the mesh panel.

With reference now to the drawings, and in particular FIGS. 1 through 10 thereof, an example of the instant wig foundation with a stitched support hem employing the principles and concepts of the present wig foundation with a stitched support hem and generally designated by the reference number 10 will be described.

Referring to FIGS. 1 through 10 the present wig foundation with a stitched support hem 10 is illustrated. The wig foundation with a stitched support hem 10 includes an inverted bowl-shaped stretchable cap 20 having a center portion 22 and a pair of semicircular side panels 24 including a right side panel 26 and a left side panel 28. The cap 20 is optionally a nylon mesh. Each of the right side panel 26 and the left side panel 28 is attached to a right edge 30 and a left edge 32, respectively, of the center portion 22 along each of a right seam 34 and a left seam 36, respectively, of a pair of seams 38. A pocketed band 40 is attached to a bottom edge 42 of the cap 20. The band 40 has a lower edge 43 and a pair of openings 44 including a right opening 46 and a left opening 48. The right opening 46 and the left opening 48 are medially disposed between a back end 50 of each of the right seam 34 and the left seam 36.

A stitched support hem 49 having a reinforcement stitching 51 and a reinforced area 53 is continuously disposed on the pocketed band 40 proximal the lower edge 43 thereof. The reinforced area 53 is between the reinforcement stitching and the bottom edge of the cap, and is used to sew on a wig.

The wig foundation with a stitched support hem 10 further includes a single elasticized strap 52 having a first end 56A and a second end 55B. The single elasticized strap is threaded through both the band 40 and the right opening 46 and the left opening 48 so that the first end 55A and the second end 55B are disposed outside of the cap. A tightening mechanism 66 is attached to the single elasticized strap 52 proximal the first end and the second end thereof, and is configured to selectively tighten the cap around a wearer 57 by selectively tightening the single elasticized strap.

An alternative embodiment of the invention includes a pair of identical elasticized straps 52A instead of the single strap 52. The pair of straps 52A includes a right strap 54 and a left strap 56. Each of the right strap 54 and the left strap 56 has a top end 58 and a bottom end 60. The top end 58 of each of the right strap 54 and the left strap 56 is attached to an interior surface 62 of the band 40 proximal a front end 64 of the right seam 34 and a front end 65 of the left seam 36, respectively. Each of the right strap 54 and the left strap 56 is threaded through both the band 40 and the right opening 46 and the left opening 48, respectively, so that the bottom end 60 of each of the right strap 54 and the left strap 56 is disposed outside of the cap 20. The tightening mechanism 66 is attached to the pair of straps 52A proximal the bottom end 60. The tightening mechanism 66 is configured to selectively tighten the cap 20 around the head of the wearer 57 by selectively tightening the pair of straps 52A.

A substantially rectangular mesh panel 23 is optionally disposed within the center portion 22 of the inverted bowl-shaped stretchable cap 20 from proximally above the pocketed band 40 to the lower edge 43 of the pocketed band 40.

What is claimed is:

1. A wig foundation with a stitched support hem, comprising:

an inverted bowl-shaped stretchable cap having a center portion and a pair of semicircular side panels comprising a right side panel and a left side panel, each of the right side panel and the left side panel attached to a right edge and a left edge, respectively, of the center portion along each of a right seam and a left seam, respectively, of a pair of seams;

a pocketed band attached to a bottom edge of the cap, the pocketed band having a lower edge and a pair of openings comprising a right opening and a left opening, wherein the right opening and the left opening are medially disposed between a back end of each of the right seam and the left seam;

a stitched support hem disposed on, and extending along, the pocketed band proximal the lower edge of the pocketed band, wherein the stitched support hem is configured to provide support to a wig;

a pair of elasticized straps comprising a right strap and a left strap, each of the right strap and the left strap having a top end and a bottom end, wherein the top end of each of the right strap and the left strap is attached to an interior surface of the pocketed band proximal a front end of the right seam and a front end of the left seam, respectively, wherein each of the right strap and the left strap is threaded through both the pocketed band and the right opening and the left opening, respectively, so that the bottom end of each of the right strap and the left strap is disposed outside of the cap; and a tightening mechanism attached to the pair of straps proximal the bottom end thereof, wherein the tightening mechanism is configured to selectively tighten the cap around a head of a wearer by selectively tightening the pair of straps.

2. The wig foundation with a stitched support hem of claim 1, further comprising a substantially rectangular mesh panel disposed within at least the center portion of the cap.

3. The wig foundation with a stitched support hem of claim 1, wherein each of the right seam and the left seam, of the pair of seams of the cap, extend in a generally front-to-back direction of the cap and terminate near the bottom edge of the cap at both a front portion and a back portion of the cap.

4. The wig foundation with a stitched support hem of claim 1, wherein the lower edge of the pocketed band is disposed below the bottom edge of the cap.

5. The wig foundation with a stitched support hem of claim 1, wherein the stitched support hem has a reinforcement stitching and a reinforced area each disposed on, and extending along, the pocketed band.

6. The wig foundation with a stitched support hem of claim 5, wherein the reinforcement stitching of the stitched support hem is disposed on, and extends along, the pocketed band proximal the lower edge of the pocketed band.

7. The wig foundation with a stitched support hem of claim 5, wherein the reinforcement stitching of the stitched support hem is disposed on, and extends along, the pocketed band above the lower edge of the pocketed band and below the bottom edge of the cap.

8. The wig foundation with a stitched support hem of claim 5, wherein the reinforced area of the stitched support hem is disposed on, and extends along, the pocketed band between at least the reinforcement stitching of the stitched support hem and the bottom edge of the cap.

9. A wig foundation with a stitched support hem, comprising:

an inverted bowl-shaped stretchable cap having a center portion and a pair of semicircular side panels comprising a right side panel and a left side panel, each of the right side panel and the left side panel attached to a right edge and a left edge, respectively, of the center portion along each of a right seam and a left seam, respectively, of a pair of seams;

a pocketed band attached to a bottom edge of the cap, the pocketed band having a lower edge and a pair of openings comprising a right opening and a left opening, wherein the right opening and the left opening are medially disposed between a back end of each of the right seam and the left seam;

a stitched support hem continuously disposed on the pocketed band proximal the lower edge of the pocketed band, wherein the stitched support hem is configured to provide support to a wig;

a single elasticized strap having a first end and a second end, wherein the single elasticized strap is threaded through both the pocketed band and the right opening and the left opening, so that the first end and the second end are disposed outside of the cap; and a tightening mechanism attached to the single elasticized strap proximal the first end and the second end thereof, wherein the tightening mechanism is configured to selectively tighten the cap around a head of a wearer by selectively tightening the singe elasticized strap.

10. The wig foundation with a stitched support hem of claim 9, wherein each of the right seam and the left seam, of the pair of seams of the cap, extend in a generally front-to-back direction of the cap and terminate near the bottom edge of the cap at both a front portion and a back portion of the cap.

11. The wig foundation with a stitched support hem of claim 9, wherein the lower edge of the pocketed band is disposed below the bottom edge of the cap.

12. The wig foundation with a stitched support hem of claim 9, wherein the stitched support hem has a reinforcement stitching and a reinforced area each continuously disposed on the pocketed band.

13. The wig foundation with a stitched support hem of claim 12, wherein the reinforcement stitching of the stitched support hem is continuously disposed on the pocketed band proximal the lower edge of the pocketed band.

14. The wig foundation with a stitched support hem of claim 12, wherein the reinforcement stitching of the stitched support hem is continuously disposed on the pocketed band above the lower edge of the pocketed band and below the bottom edge of the cap.

15. The wig foundation with a stitched support hem of claim 12, wherein the reinforced area of the stitched support hem is continuously disposed on the pocketed band between at least the reinforcement stitching of the stitched support hem and the bottom edge of the cap.

16. A wig foundation with a stitched support hem, comprising:

an inverted bowl-shaped stretchable cap having a center portion and a pair of side panels comprising a right side panel and a left side panel, each of the right side panel and the left side panel attached to a right edge and a left edge, respectively, of the center portion along each of a right seam and a left seam, respectively, of a pair of seams, wherein each of the right seam and the left seam extend in a generally front-to-back direction of the cap and terminate near a bottom edge of the cap at both a front portion and a back portion of the cap;

a pocketed band attached to the bottom edge of the cap, the pocketed band having a lower edge disposed below the bottom edge of the cap and a pair of openings comprising a right opening and a left opening, wherein the right opening and the left opening are medially disposed between a back end of each of the right seam and the left seam;

a stitched support hem disposed on, and extending along, the pocketed band proximal the lower edge of the pocketed band, wherein the stitched support hem has a reinforcement stitching and a reinforced area each disposed on, and extending along, the pocketed band, wherein the stitched support hem is configured to provide support to a wig;

at least one elasticized strap having a first end and a second end, wherein the at least one elasticized strap is threaded through both the pocketed band and the right opening and the left opening, so that the first end and the second end are disposed outside of the cap; and a tightening mechanism attached to the at least one elasticized strap proximal the first end and the second end thereof, wherein the tightening mechanism is configured to selectively tighten the cap around a head of a wearer by selectively tightening the at least one elasticized strap.

17. The wig foundation with a stitched support hem of claim 16, further comprising a substantially rectangular mesh panel disposed within at least the center portion of the cap.

18. The wig foundation with a stitched support hem of claim 16, wherein the reinforcement stitching of the stitched support hem is disposed on, and extends along, the pocketed band proximal the lower edge of the pocketed band.

19. The wig foundation with a stitched support hem of claim 16, wherein the reinforcement stitching of the stitched support hem is disposed on, and extends along, the pocketed band above the lower edge of the pocketed band and below the bottom edge of the cap.

20. The wig foundation with a stitched support hem of claim 16, wherein the reinforced area of the stitched support hem is disposed on, and extends along, the pocketed band between at least the reinforcement stitching of the stitched support hem and the bottom edge of the cap.

* * * * *